United States Patent [19]

Shimizu

[11] 4,011,029

[45] Mar. 8, 1977

[54] FLUID SUCTION AND DISCHARGE APPARATUS

[75] Inventor: Shigemi Shimizu, Sakai, Japan

[73] Assignee: Sankyo Electric Company Limited, Isesaki, Japan

[22] Filed: May 16, 1975

[21] Appl. No.: 578,311

[30] Foreign Application Priority Data

May 17, 1974 Japan ..... 49-56031
May 17, 1974 Japan ..... 49-56032

[52] U.S. Cl. ..... 417/269
[51] Int. Cl.[2] ..... F04B 1/12
[58] Field of Search ..... 417/269, 454, 270; 92/169, 171

[56] References Cited

UNITED STATES PATENTS

| | | | |
|---|---|---|---|
| 2,138,194 | 11/1938 | Pfauser | 417/454 |
| 3,085,514 | 4/1963 | Budzich | 417/269 |
| 3,436,085 | 4/1969 | Polk | 92/169 |
| 3,761,202 | 9/1973 | Mitchell | 417/269 |
| 3,838,942 | 10/1974 | Pokorny | 417/269 |
| 3,861,829 | 1/1975 | Roberts et al. | 417/53 |

*Primary Examiner*—Carlton R. Croyle
*Assistant Examiner*—G. P. LaPointe
*Attorney, Agent, or Firm*—Hopgood, Calimafde, Kalil, Blaustein & Lieberman

[57] ABSTRACT

A fluid suction and discharge apparatus of a small volume suitable for a fluid compressor which can be used for an air-conditioning system, which includes a cylinder block having a plurality of axially directed cylinders formed therein in annular relation and a single sheet of suction reed valve means which is formed of a metal sheet and with a plurality of holes corresponding to a plurality of cylinders and with a plurality of suction reeds extending in the holes respectively and means for preventing the fluid such as a refrigerant gas from leaking out of the cylinders through the contact gap between the suction reed valve means and a valve plate which the suction reed valve is secured to and is in contact with.

The valve plate is secured onto one end surface of the cylinder block by means of bolts which extend through the valve plate, the suction reed valve means and a gasket which is held between the cylinder block and the suction reed valve means. The valve plate is formed with annular grooves for O-rings at the peripheral portion and at surroundings of holes through which the bolt means extend on one surface thereof facing the suction reed valve means. O-rings are fitted into the annular grooves and compressed between the suction reed valve means and the valve plate, thereby preventing the leakage of the fluid.

The suction reed valve means may be formed with a reduced area less than the radial extent of the valve plate and may be contained in the spot faced recess formed in the end surface of the cylinder block, with a central portion of the gasket being placed in the recess and between the cylinder block and the suction reed valve means and with the peripheral portion of the gasket being directly placed between the cylinder block and the valve plate, thereby the leakage of the fluid being prevented.

2 Claims, 9 Drawing Figures

FLUID SUCTION AND DISCHARGE APPARATUS

BACKGROUND OF THE INVENTION

This invention relates to fluid suction and discharge apparatus including a cylinder block having a plurality of cylinders and pistons slidably reciprocated in cylinders, for example fluid compressors, and, in particular, to improvements of the seal between the cylinder block and the valve plate of such apparatus.

A fluid suction and discharge apparatus has been known and used in the prior art for a compressor for a refrigerant system, which comprises a cylinder block formed with a plurality of cylinders, pistons slidably reciprocated in the cylinders, a valve plate secured to the cylinder block by means such as bolts and formed with inlet openings and outlet openings in registry with the plurality of cylinders, discharge reed valve means secured to the valve plate for control of the outlet openings, and suction reed valve means secured to the valve plate for control of the inlet openings.

It is complicated in the construction and the assembling operation to secure separate suction reed valves to the valve plate correspondingly to each cylinder.

Accordingly, a single sheet of suction reed valve means formed of a metal sheet and formed with a plurality of suction reeds correspondingly to the cylinders is mounted between the cylinder block and the valve plate.

In the use of the single sheet of reed valve means, a gasket means is put and held between the cylinder block and the suction reed valve means to prevent the fluid such as refrigerant gas from leakage through the narrow gap therebetween. But no gasket can be put between the suction reed valve means and the valve plate because they must be in contact with one another. Therefore, the fluid leaks between the suction reed valve means and the valve plate.

In the application to compressors, a housing is provided surrounding the cylinder block and an O-ring is mounted between the housing and the cylinder head which is mounted on the valve plate. This construction results in an increase in the volume of the compressor. Therefore, it is undesirable in order to apply this construction to compressors for use in air-conditioning refrigerant systems such as are used in automobiles.

SUMMARY OF THE INVENTION

An object of this invention is to provide a fluid suction and discharge apparatus suitable for a fluid compressor which includes a cylinder block formed with a plurality of cylinders, a valve plate, a suction reed valve means formed with a plurality of suction reeds corresponding to respective cylinder and seals for preventing the fluid from leakage between the cylinder block and the valve plate.

Another object of this invention is to provide such an apparatus wherein no fluid is leaked out through the gap between the single sheet of reed valve means and the valve plate and therefrom through the gaps surrounding the bolts in the holes of the valve plate which is secured to the cylinder block by means of the bolts extending in the holes.

Still another object of this invention is to realize the above objects with a simple construction without any increase of the volume in the apparatus.

The fluid suction and discharge apparatus according to the invention includes a cylinder block formed with a plurality of cylinders in parallel with one another. Pistons are slidably reciprocated in the cylinders for the fluid suction and discharge and a valve plate is secured to the cylinder block at one end thereof with inlet and outlet openings in registry with each cylinder. A single sheet of suction reed valve means is formed of a metal sheet of similar extent as the valve plate and is formed with a plurality of holes corresponding to respective cylinders and with a plurality of suction reeds respectively extending in the holes. The suction reed valve means is held between the cylinder block and the valve plate, and a gasket of similar extent as the valve plate is held between the suction reed valve means and the cylinder block. The valve plate is secured to said cylinder block by means of bolts extending through said valve plate, said suction reed valve means and said gasket. The valve plate is formed with an annular groove at the peripheral portion on an end surface thereof facing said suction reed valve means, with an O-ring being fitted into said annular groove and another annular groove is formed on said surface of said valve plate surrounding each hole for the insertion of said bolt means, with other O-rings being fitted into said another annular grooves.

In another aspect of this invention, the suction reed valve means is formed of a metal sheet of an extent less than said valve plate. The valve plate is secured to said cylinder block by means of bolts extending through said valve plate and said gasket, a spot faced recess being formed in one end surface of said cylinder block facing said gasket, said recess having an extent and a thickness corresponding to said suction reed valve means so as to contain said suction reed valve means therein. The gasket is placed between, and is in contact with, said cylinder block and said valve plate at the peripheral portion thereof, and said cylinder block and said suction reed valve at the central portion thereof.

According to this invention, a fluid compressor suitable for use in an air-conditioning refrigerant system for an automobile can be obtained.

Further objects and features of this invention will be understood from the following description of several embodiments of this invention referring to the annexed drawings, in which:

DETAILED DESCRIPTION OF PREFERRED EMBODIMENTS

Figure 1:
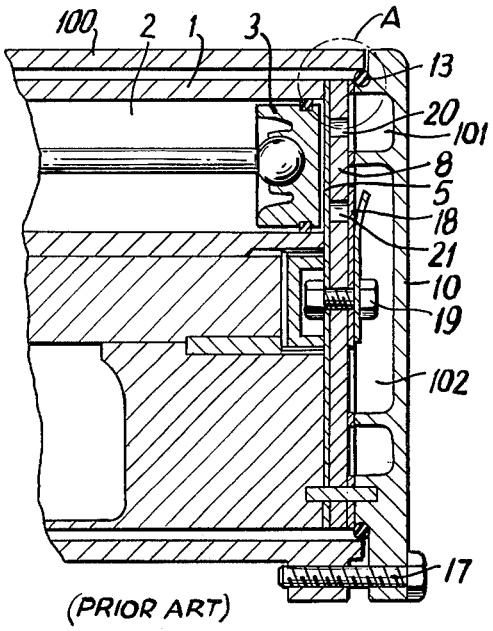
(PRIOR ART) FIG. 1
FIG. 1 is a cross-sectional view of a portion of a conventional compressor.
Figure 2:
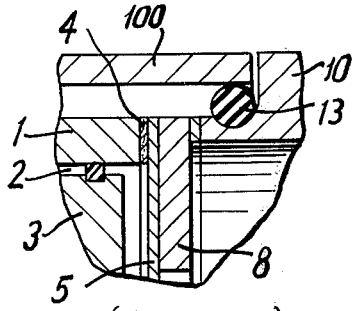
(PRIOR ART) FIG 2
FIG. 2 is an enlarged sectional view of a portion indicated by A in FIG. 1.
Figure 1A:
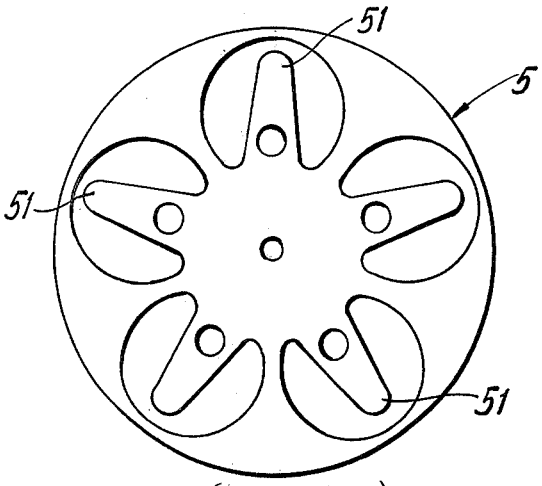
(PRIOR ART) FIG 1a
FIG. 1*a* is a plan view of a suction reed valve used in the compressor shown in FIG. 1.

Referring to FIGS. 1, 1*a* and 2, there is shown a known compressor including a fluid suction and discharge apparatus comprising a cylinder block 1 having a plurality of axially directed cylinders 2 formed therein in spaced annular relation. In each cylinder 2, a piston 3 is slidably close-fitted and is reciprocated by any suitable means. A valve plate 8, which may be of circular shape and formed with inlet and outlet openings 20 and 21 in registry with each cylinder 2 is secured to the cylinder block 1 onto one end thereof. Between the cylinder block 1 and the valve plate 8, a single sheet of suction reed valve means 5, which is formed of a metal sheet of a similar shape of the valve plate and provided with a plurality of suction reeds 51 as shown in FIG. 1*a*, is held. On the opposite surface of the valve plate discharge reed valve means 18 is mounted. The suction reed valve means 5 and the discharge reed valve means 18 are secured to the valve plate 8 by means of, such as a bolt 19. On the valve plate 8, a cylinder head 10 is mounted which is formed with a suction chamber 101 and a discharge chamber 102 in registry with inlet openings 20 and outlet openings 21 of the valve plate respectively.

A fluid, such as a refrigerant gas, in response to the reciprocation of pistons 2, is introduced in the cylinders 3 from the suction chamber 101 and is discharged therefrom to the discharge chamber 102. Thus the gas is recirculated in the refrigerant system (not shown) connected to the suction and discharge chambers.

To prevent the fluid from leaking out through a narrow gap between the cylinder block 1 and the suction reed valve means 5, a gasket 4 having a similar circular shape as the valve plate is put and held between the cylinder block 1 and the suction reed valve means 5. But the fluid leaks out through another narrow gap between the suction reed valve means 5 and the valve plate 8. No gasket can be inserted between the suction reed valve means 5 and the valve plate 8 because a tight contact must be established therebetween.

To suppress the leakage of the fluid through the gap between the suction reed valve means 5 and the valve plate 8, a housing 100 is provided surrounding the cylinder block 1 and is secured to the cylinder head 10 by means of bolts 17 with an O-ring 14 therebetween.

But this solution introduces an increase in the volume of the compressor.

An important object of this invention is to prevent the leakage of the fluid through the narrow gap between the suction reed valve means 5 and the valve plate 8 to reduce the volume of the compressor.

Figure 3:
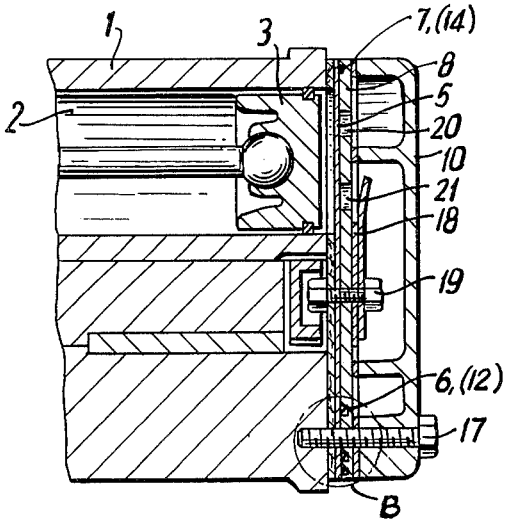
FIG. 3 is a cross-sectional view of a compressor according to one embodiment of this invention.
Figure 5:
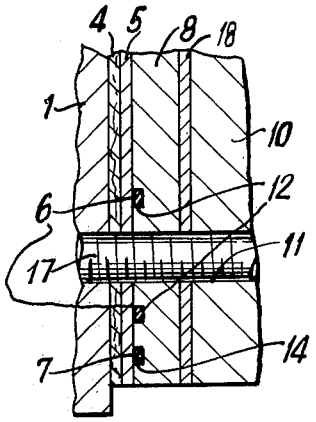
FIG. 5 is an enlarged cross sectional view of a compressor according to a portion indicated by B in FIG. 3.
Figure 4:
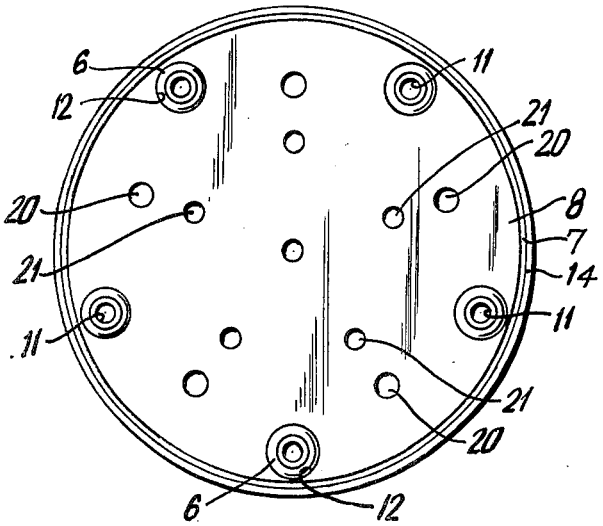
FIG. 4 is a view of an end surface of the valve plate of the compressor shown in FIG. 3, which faces the cylinder block.

Referring to FIGS. 3–5, an embodiment of the invention is there shown in in which the cylinder head 10 is secured to the cylinder block 1 by bolts 17 extending through holes 11 formed in the cylinder head 10, the valve plate 8, the suction reed valve means 5 and the gasket 4, and the valve plate 8 is formed with an annular groove 14 at the periphery thereof on an end surface thereof facing the suction reed valve 5 and with another annular grooves 12 on the end surface thereof surrounding each hole 11 for inserting each bolt 17, with O-rings 6 and 7 (FIGS. 4 and 5) being fitted in annular grooves 12 and 14 respectively.

When the cylinder head 10 is secured to the cylinder block 1 by bolts means 17, the O-rings are compressed to permit the suction reed valve means 5 to be in contact with the valve plate 8. So that the fluid which flows between the suction reed valve means 5 and the valve plate 8 is stopped at O-rings, thereby to prevent the fluid from leaking through the narrow gap between the suction reed valve means 5 and the valve plate 8 and through the annular gap surrounding each bolt 17.

Accordingly, such a housing 100 as in FIG. 1 must not be used in the compressor of this invention so that the volume of the compressor may be reduced.

The other components of the compressor of the invention are substantially similar to those in the compressor shown in FIGS. 1, 1*a* and 2 and, are therefore, not further described herein.

Figure 6:
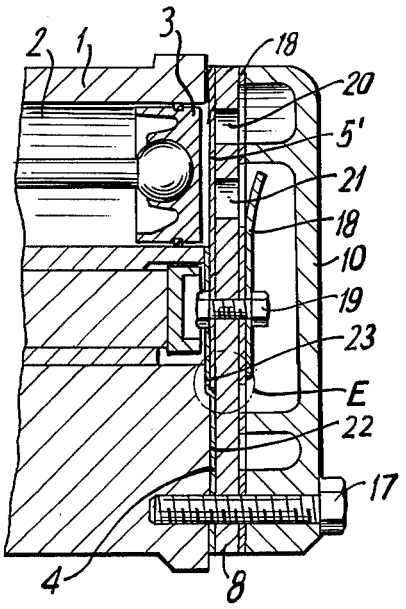
FIG. 6 shows a sectional view of another embodiment of the invention.
Figure 8:
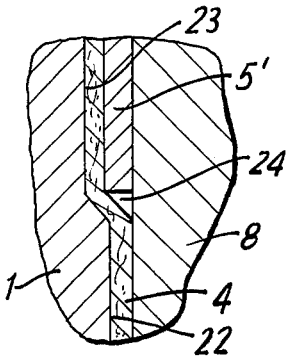
FIG. 8 is an enlarged cross-sectional view of a portion indicated by E in FIG. 6.
Figure 7:
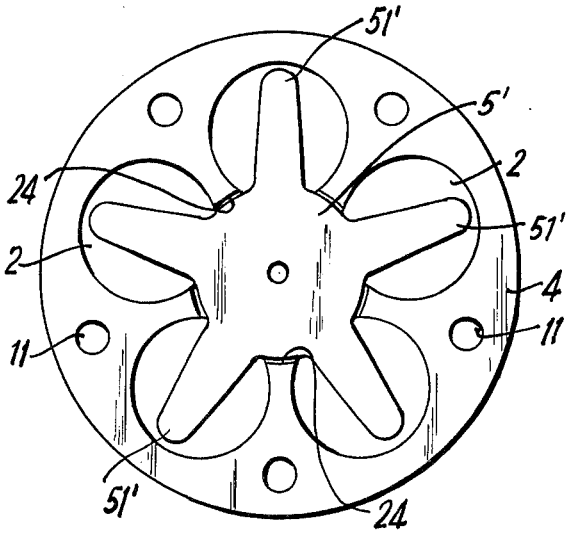
FIG. 7 is an end view of the compressor in FIG. 6 with the valve plate, discharge reed valve means and cylinder head being removed.

Referring to FIGS. 6, 7 and 8, there is shown another embodiment of this invention in which the suction reed valve means 5 is formed with a reduced plane extent smaller than the end surface of the cylinder block 1. In the drawing, the suction reed valve means 5′ comprises a central portion corresponding to the central region of the end surface of the cylinder block 1 surrounded by a plurality of, for example, five cylinders formed in annular relation, and five reeds 51′ radially extending therefrom.

The end surface 22 of the cylinder block 1 is formed with a spot faced recess 23 at the central region thereof which connects with all cylinders. The recess 23 is for accomodation of the suction reed valve means 5′ and, therefor therefore, is formed correspondingly to the shape and thickness of the suction reed valve means 5′.

Inserting the gasket 4 and the suction reed valve means 5′ between the cylinder block 1 and the valve plate 8, the valve plate 8 and the cylinder head 10 are mounted on, and secured by bolts means 17 to, the cylinder block 1.

Since the suction reed valve means 5′ is formed with a reduced plane extent, it does not extend to the peripheries of the cylinder block 1 and the valve plate 8 so that the cylinder block 1 and the valve plate 8 hold only a gasket 4 therebetween at the peripheral portion thereof. Accordingly the fluid does not leak out between the cylinder block 1 and the valve plate 8.

On the other hand, in the recess 23 the gasket 4 and the suction reed valve means 5′ are accomodated so that the outer surface of the suction valve means 5′ is in the plane of the outer surface of a peripheral portion of the gasket which portion is not accomodated in the recess 23. The valve plate 8 is thus maintained in contact with the suction reed valve means 5′ and also in tight contact with the peripheral portion of the gasket.

Of course, the suction reed valve means 5′ does not extend to the region through which bolts means 17 extend.

In this construction, a narrow gap 24 exists between the peripheral end surface of the central portion of the suction reed valve means 5′ and the gasket 4, as shown in FIG. 8, the gap 24 communicates between adjacent cylinders. Some of the fluid thus may leak from one cylinder to adjacent cylinders but this leakage is so little that the efficiency of the compressor is not degraded. Furthermore, the gap 24 can be controlled narrower by the extent of the recess 23.

In this embodiment, a housing 100, as in the conventional compressor shown in FIG. 1, is also unnecessary so that the volume of the compressor is reduced.

It is readily understood by those skilled in the art that a similar conception can be applied to a compressor including a cylinder block having a plurality of axially directed cylinders formed therein in parallel relation but not in annular relation.

This invention has been described in conjunction with specific embodiments but these embodiments are only for purposes of description and do not restrict of the invention. Various modifications and designations are easily made by those skilled in the art within the scope of this invention.

What we claim is:

1. In a fluid suction and discharge apparatus including a cylinder block formed with a plurality of cylinders in parallel with one another, pistons slidably reciprocated in the cylinders for fluid suction and discharge, a valve plate secured to the cylinder block at one end thereof with inlet and outlet openings in registry with each of said cylinders, discharge valve means, a sheet of suction reed valve means formed of a metal sheet and formed with a plurality of suction reeds corresponding to respective ones of said cylinders, the suction reed valve means being held between the cylinder block and the valve plate, and a gasket of similar extent as the valve plate being held between the suction reed valve means and the cylinder block, the improvement which comprises: said suction reed valve means being formed of a metal sheet of an extent less than said valve plate, said valve plate being secured to said cylinder block by means of bolts extending through said valve plate and said gasket, a spot faced recess being formed in one end surface of said cylinder block facing said gasket, said recess having an extent and a thickness corresponding to said suction reed valve means so as to contain said suction reed valve means therein, said gasket being placed between, and being in contact with, said cylinder block and said valve plate at the peripheral portion thereof, and said cylinder block and said suction valve at the central portion thereof.

2. The apparatus as claimed in claim 1, wherein said end surface of said cylinder block, said gasket and said valve plate are formed in a circular shape, said cylinders being formed in said cylinder block in annular relation, said spot faced recess being formed in said end surface of said cylinder at the central portion thereof, said suction reed valve means comprising a central portion and a plurality of suction reeds radially outwardly extending in registry with said respective cylinders.

* * * * *